United States Patent [19]

Rojey

[11] 4,422,297

[45] Dec. 27, 1983

[54] PROCESS FOR CONVERTING HEAT TO MECHANICAL POWER WITH THE USE OF A FLUIDS MIXTURE AS THE WORKING FLUID

[75] Inventor: Alexandre Rojey, Garches, France

[73] Assignee: Institut Francais du Petrole, Ruéll-Malmison, France

[21] Appl. No.: 266,569

[22] Filed: May 22, 1981

[30] Foreign Application Priority Data

May 23, 1980 [FR] France ..... 80 11649

[51] Int. Cl.[3] ..... F01K 25/06

[52] U.S. Cl. ..... 60/651; 60/671

[58] Field of Search ..... 60/645, 651, 671

[56] References Cited

U.S. PATENT DOCUMENTS 4,242,870 1/1981 Searingen ..... 60/671 X

*Primary Examiner*—Allen M. Ostrager

*Attorney, Agent, or Firm*—Millen & White

[57] ABSTRACT

Mechanical power is generated by a process comprising (a) progressive vaporization of a mixture of fluids, (b) expansion of the resultant vapor, (c) condensation of the vapor and (d) recycling to step (a) of the liquid phase obtained in step (c). The heat exchanges are effected counter-currently, thus providing parallel evolutions of temperature. The condensation is effected in a temperature interval of from 7° to 30° C.

12 Claims, 4 Drawing Figures

PROCESS FOR CONVERTING HEAT TO MECHANICAL POWER WITH THE USE OF A FLUIDS MIXTURE AS THE WORKING FLUID

BACKGROUND OF THE INVENTION

This invention relates to the conversion of thermal energy to mechanical energy via a working fluid.

The necessity to spare power and to use new power sources leads to develop processes for the production of mechanical power, which can be used as such or converted to electrical power, from heat sources of low thermal level, thus in a temperature range from, for example, 50° to 400° C. These heat sources may be of different nature: industrial thermal wastes, heat transmitted through solar collectors, geothermal water, etc. These heat sources can be used to generate mechanical power by means of a Rankine cycle using a working fluid which vaporizes under pressure while receiving heat from the heat source, expands while producing mechanical power, for example, in a turbine, this mechanical power being used as such or converted to electricity, and condenses when contacted with a refrigerant fluid, such as water or air.

The yield of the cycle can be improved and the use of very low pressures avoided by replacing water, a fluid which is commonly used at higher temperatures, with a fluid whose boiling temperature and critical temperature are much lower, such as butane or ammonia.

A fluid of this type vaporizes and condenses at a substantially constant temperature.

It is a rule that the temperature of the external fluids with which the exchanges are effected varies during the exchange.

SUMMARY

It has been found, and this is an object of the present invention, that it is advantageous in that case to use a mixture of fluids which vaporizes and condenses progressively, following the temperature evolution of each external fluid with which the exchange takes place.

The mixture vaporizes in a temperature interval A while receiving heat from an external fluid I constituting the heat source and whose temperature itself varies in temperature interval A'. It then expands while producing mechanical power which can be used directly or converted to electrical power and then condenses in a temperature interval B while delivering heat to an external fluid II which constitutes the cooling fluid and whose temperature varies in a temperature interval B'.

To obtain the full advantages of the process according to the invention, it is however necessary to respect certain conditions.

Figure 1:
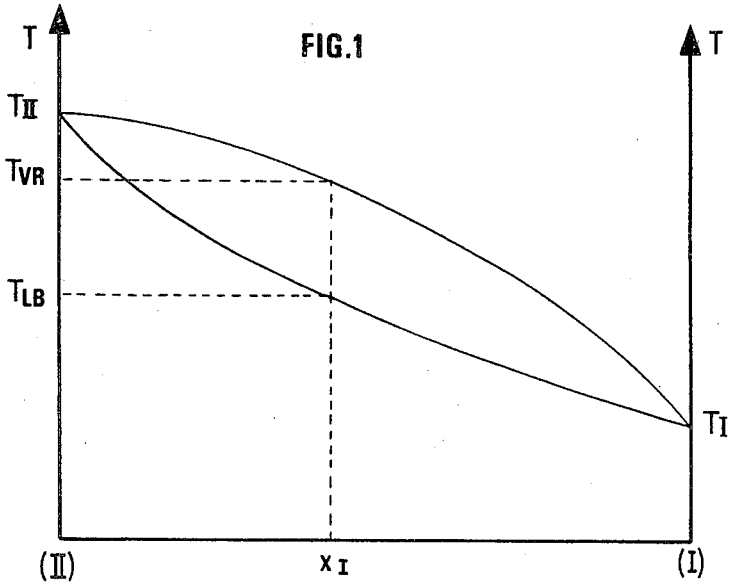
FIG. 1 is a temperature-composition phase diagram for the vaporization step.

A maximum yield is obtained when the temperature intervals A and B are as close to the temperature intervals A' and B' as possible, which corresponds to the best conditions of thermodynamic reversibility. Once selected the temperature interval A', in which heat is delivered to the cycle, the composition of the mixture is so selected as to have a vaporization interval A close to the temperature interval A'. With a binary mixture, the temperature interval A normally varies as shown in the diagram of FIG. 1. In the case of a given molar fraction $x_1$ of the constituent I of higher volatility of a mixture of constituents I and II whose vaporization temperatures at the selected pressure are $T_I$ and $T_{II}$, the vaporization of the mixture starts at the bubble point of the liquid $T_{LB}$ and terminates at the dew point of the vapor $T_{VR}$. The vaporization interval is thus defined by the temperatures $T_{LB}$ and $T_{VR}$ and can be adjusted by selecting the appropriate composition.

The condensation interval B is generally close to the vaporization interval A. It is advantageous, in that case, to select the feed rate of the cooling fluid (water or air) employed for condensation, so that the temperature interval B' be close to the condensation interval B.

This has also the advantage, as compared with working with a pure material, of reducing the feed rate of the cooling water or air and of decreasing the power consumption necessary to coolant air blowing or to coolant water pumping. However it is necessary to take care that the temperature interval B be not too large to avoid a loss of yield. For this reason, it is necessary to limit the temperature interval B to a value of 30° C. On the other hand, this interval must be at least 7° C. to obtain a noticeable increase in yield attributable to the use of a mixture. Consequently a temperature interval B between 7° to 30° C. is necessary to operate under conditions of optimal yield and benefit of the advantages linked to the use of a mixture. This condition also applies, as a rule, to the temperature interval A which is usually close to the temperature interval B when the vaporization is effected in one single step.

An embodiment of the process is described with reference to example 1.

EXAMPLE 1

Figure 2:
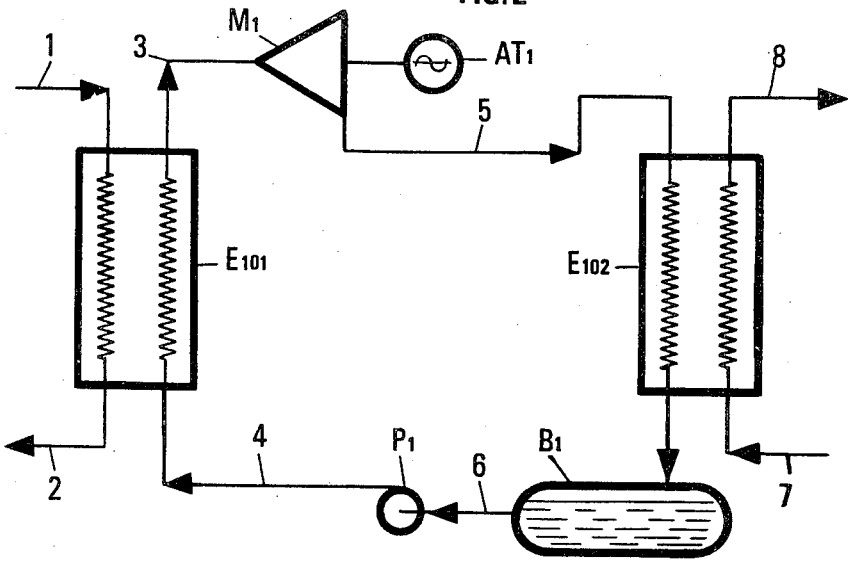

This example is illustrated by FIG. 2. A stream of 5.67 $m^3/h$ of water is supplied through duct 1 at a temperature of 85° C. 1254 kg/h of a mixture having the following composition (in molar fractions) are supplied through duct 4:

normal butane: 0.8 normal hexane: 0.2

This mixture is fed at 20° C. and begins to vaporize at 52° C. while exchanging heat counter-currently to water fed through duct 1 into exchanger E101. After exchange, water is discharged from the exchanger E101 through duct 2 at a temperature of 60° C. and the vaporized mixture is withdrawn from the exchanger E101 through duct 3 at a temperature of 75° C. and a pressure of 4.1 bars.

The mixture then expands in the blade motor $M_1$ driving the alternator AT1. An electric power of 9 kw is delivered at the terminals of the alternator. The mixture is discharged from the blade motor $M_1$ at a pressure of 1.6 bars. It condenses progressively in the exchanger E102 and falls into the storage drum B1. Cooling is effected with water fed at 12° C. through duct 7 and discharged at 32° C. through duct 8. The liquid mixture is passed through duct 6 and pump P1 and recycled to the evaporator E101.

In this example, the use of a mixture of butane with hexane shows the temperature evolution of the external fluids in the course of the vaporization and condensation steps, the mixture of fluids vaporizing according to an increasing temperature evolution parallel to the decreasing temperature evolution of the external fluid I and condensing according to a decreasing temperature evolution parallel to the increasing temperature evolution of the external fluid II. These temperature evolutions necessitate that the heat exchanges at the evaporator and at the condenser be effected under conditions as close to the counter-current as possible. A pure counter-current exchange is the preferred method; however for equipment reasons, it is also possible to have exchange surfaces of the counter-current type, although each exchange surface of said arrangement operates under conditions distinct from the counter-current, for example according to a crossed stream heat exchanger or with one of the fluids circulating in U-shaped tubes.

The mixtures can comprise two, three or more constituents (distinct chemical compounds). The constituents of the mixture can be hydrocarbons whose molecule comprises, for example, from 3 to 8 carbon atoms, such as propane, normal butane and isobutane, normal pentane and isopentane, normal hexane and isohexane, normal heptane and isoheptane, normal octane and isooctane, as well as aromatic hydrocarbons such as benzene and toluene and cyclic hydrocarbons such as cyclopentane and cyclohexane. When it is desired that the mixture be not inflammable or be hardly inflammable, the mixture can be a mixture of halgenated hydrocarbons of the "Freon" type, such as chlorodifluoromethane (R-22), dichlorodifluoromethane (R-12), chloropentafluoroethane (R-115), difluoroethane (R-152), tricholofluoromethane (R-11), dichlorotetrafluoroethane (R-114), dichlorohexafluoropropane (R-216), dichlorofluoromethane (R-21) or trichlorotrifluoroethane (R-113). One of the constituents of the mixture can be an azeotrope such as R-502, an azeotrope of R-22 with R-115 (48.8/52.2% b.w.), R-500, an azeotrope of R-12 with R-31 (78.0/22.0% b.w.) and R-506, an azeotrope of R-31 with R-114 (55.1/44.9% b.w.).

Other types of mixtures are those comprising water and at least one second constituent miscible with water, such as water-ammonia mixtures, mixtures of water with an amine such as methylamine or ethylamine, mixtures of water with an alcohol such as methanol, mixtures of water with a ketone such as acetone.

When the process operates according to the diagram of FIG. 2, the composition of the mixture is so selected that the vaporization interval A and the condensation interval B are as close as possible to the temperature intervals A' and B' followed by the external fluids. A maximum yield is obtained when the difference between the temperature intervals A and A' is lower than 5° C.

It has also been found that, when the working fluid consists of a mixture, other improvements may be obtained when, at a point of the circuit, the mixture is divided into two fractions which are re-mixed at another point of the circuit, one of said fractions being subjected to all the steps of the cycle and the other one to only part of the steps of this cycle.

Figure 3:
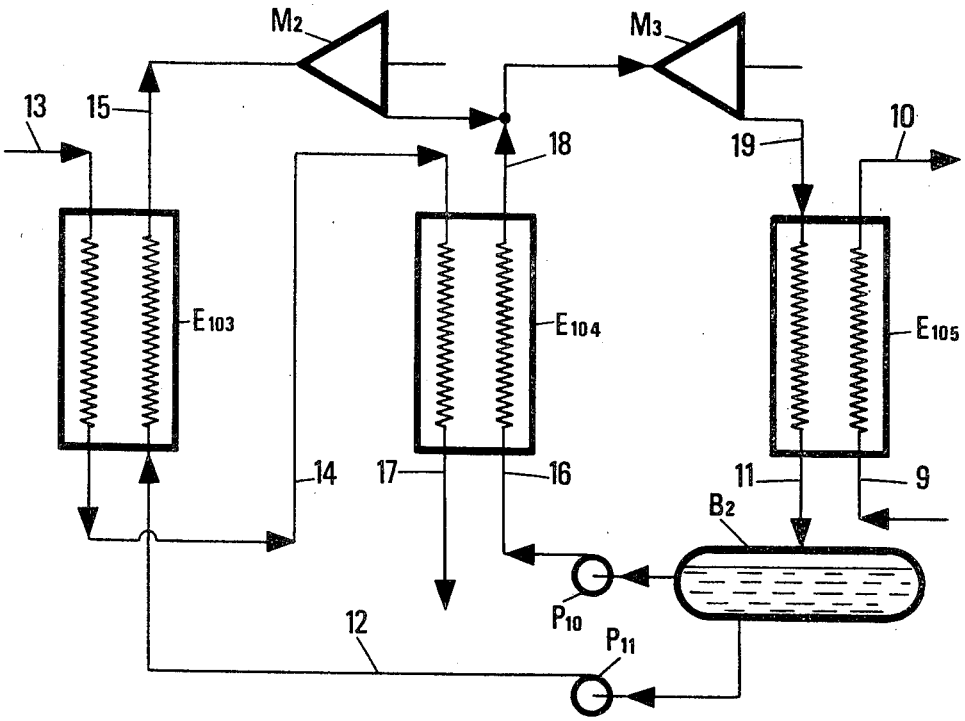

When the heat recovered at the evaporator is available in a relatively wide temperature interval and the mixture is selected to vaporize in a narrow temperature interval, operating according to the diagram of FIG. 2 leads to an operation having a wide temperature interval B, which does not correspond to the most favorable yield conditions. In that case it is possible to operate according to the diagram of FIG. 3. The mixture condenses in exchanger E105 while being cooled by an external fluid supplied through duct 9 and discharged through duct 10. The condensed mixture is withdrawn from the exchanger E105 through duct 11 and is fed to the storage drum B2. Pump P11 supplies a fraction of the liquid mixture through duct 12 into exchanger E103 where it vaporizes in a temperature interval $A_1$ while exchanging heat with an external fluid fed through duct 13 and discharged through duct 14. The mixture in the vaporized state is discharged from the exchanger E103 through the duct 15 and supplied to the motor stage M2. Pump P10 feeds the remaining fraction of the liquid mixture through duct 16 to exchanger E104 wherein it vaporizes in a temperature interval $A_2$ while exchanging heat with the external fluid supplied through duct 14 and discharged through duct 17. The mixture is discharged in the vaporized state from the exchanger E104 and the resultant vapor is admixed with the vapor obtained by expansion in stage M2 and expanded, together with vapor from stage M2, in the motor stage M3; it is discharged through duct 19.

Provided the intermediate pressure level is well selected, thus the pressure at which the mixture vaporizes in exchanger E104, the temperature intervals $A_1$ and $A_2$ may be consecutive; it is thus possible to follow with the mixture a temperature evolution of the external fluid which delivers heat to the cycle, corresponding to a temperature interval A' parallel to that about 2 times larger as in the embodiment shown in FIG. 2.

Figure 4:
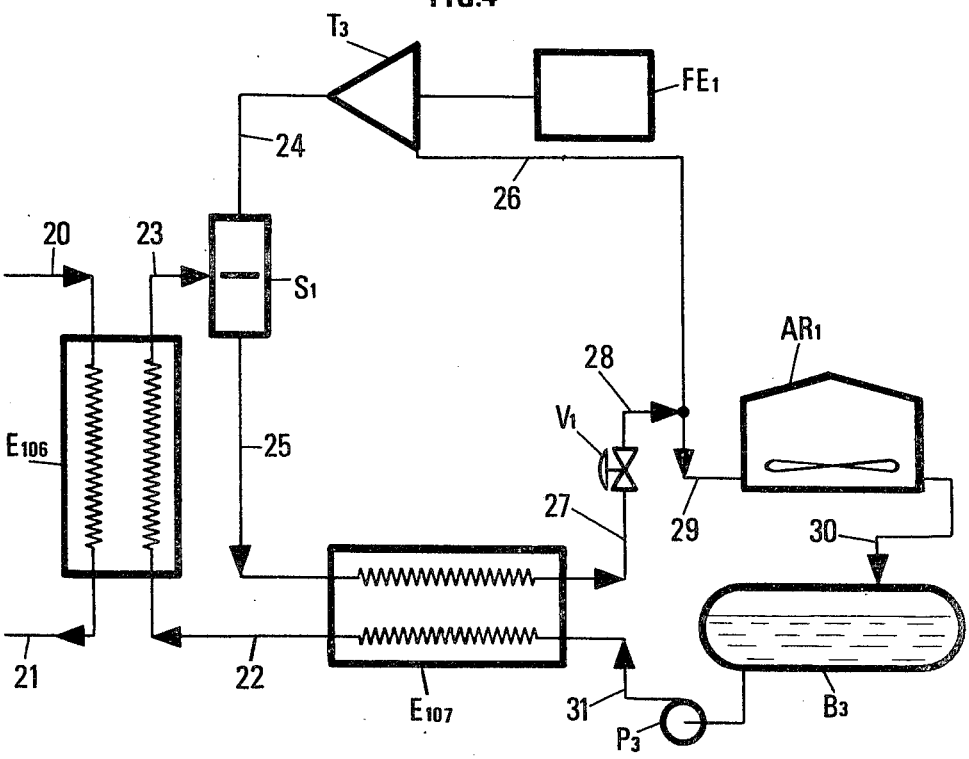
FIGS. 2, 3 and 4 are schematic illustrations of embodiments of the invention.

It has also been found that, in many cases, it is particularly advantageous to operate according to the arrangement shown in FIG. 4. The condensed mixture vaporizes only partially in the exchanger E106 while receiving heat from the external fluid supplied through duct 20 and discharged through duct 21. At the outlet from the exchanger E106, the liquid and vapor fractions are separated in the separation drum S1. The vapor fraction is expanded in turbine T3. The liquid phase is supplied to the exchanger E107 where it exchanges heat with the condensed mixture fed to the evaporator; it is then expanded through the expansion valve V1 and admixed with the expanded vapor phase discharged from turbine T3. The resultant liquid vapor mixture condenses while delivering heat to an external cooling medium; it is collected in the storage drum B3 and recycled to the evaporator through pump P3. The conditions for operating a device according to the arrangement of FIG. 4 are described in example 2.

EXAMPLE 2

This example is illustrated by FIG. 4. 3956 kg/h of a water-ammonia mixture of the following composition (fraction by weight):

$NH_3$:0.75

$H_2O$:0.25 are circulated through pump P3. This mixture is supplied through duct 31 to the exchanger E107 wherefrom it is discharged through duct 22 at a temperature of 55° C. It is then supplied to the exchanger E106 where it partially vaporizes while receiving a thermal energy of 1585 kw per hour from a stream of water fed through duct 20 at a temperature of 90° C. and discharged through duct 21 at a temperature of 65° C. The liquid-vapor mixture is discharged from the exchanger E106 through duct 23 at a temperature of 85° C. and at a pressure of 20 bars. It is collected in the separation drum S1 where the liquid and vapor phase separate. The liquid phase contains 52% ammonia by weight. It is discharged through duct 25 and fed to the exchanger E107.

The vapor phase is supplied through duct 24 to the turbine T3 where it expands to a pressure of 8 bars. A power of 100 kw is recovered on the shaft of the turbine T3 by means of the electric brake FE1. The expanded vapor is discharged through duct 26. The liquid phase discharged through duct 27 from the exchanger E107 is expanded through the expansion valve V1, wherefrom it is discharged through duct 28. It is then admixed with the vapor phase fed from duct 26 and the liquid-vapor mixture is fed through duct 29 to the air-cooler AR1 where it fully condenses and wherefrom it is discharged through duct 30 at a temperature of 28° C. The air-cooler AR1 is made of pipes provided with small wings, through which the condensing mixture circulates, these pipes being arranged as 5 sheets placed cross-wise to the air circulation but linked counter-currently, the mixture thus circulating approximately counter-currently to the cooling air. The condensed mixture is collected in the storage drum B3, wherefrom it is discharged through the feed pump P3.

The arrangement of FIG. 4 can be adapted to variable operating conditions. For example, by modifying the stream supplied from pump P3 to the duct 31, it is possible to modify the levels of pressure in the evaporator and in the condenser. Thus, when increasing the delivery rate of the pump P3, at given outlet temperatures in the evaporator and the condenser, the pressure levels decrease in the evaporator and the condenser, thereby reducing the capacity of the system, thus the power available on the shaft.

As a rule, the embodiment of FIG. 4 considerably widens the possibilities of use of the mixtures in power cycles.

It permits the use of mixtures of constituents whose boiling temperatures are very different, such as water and ammonia, in cases where the temperature intervals in the evaporator and the condenser are narrow, for example of about 10° to 15° C., since only partial vaporization takes place in the evaporator, which allows one to operate with so narrow an interval as desired.

On the other hand, as mentioned above, the pressure levels can be adjusted by selecting the concentration of the circulated solution. It is thus possible to operate under optimum conditions with a reduced rate of feed by volume and thus with an expansion machine of low volume without using excessive pressures which would lead to excessive investments.

Irrespective of the type of running, the run conditions are usually so selected as to have a pressure of the mixture in the evaporator between 3 and 30 bars and a pressure of the mixture in the condenser between 1 and 10 bars. The temperature range A is usually selected between 50° and 350° C. and the temperature range B between 20° and 80° C.

The embodiments given by way of examples are not limitative and, for example, all the improvements to the Rankine cycles known to the specialists and using a pure compound as the working fluid can be used when operating with mixtures. For example, when the engine used to expand the vapor phase has several stages, it is possible to preheat the liquid mixture fed to the evaporator by exchanging heat with a vapor fraction collected between two stages of the engine, the condensation of this vapor fraction being used to preheat the liquid mixture.

It is also possible to modify the basic arrangements described above. For example, the vaporization can be effected in two or more steps at different pressure levels to broaden the interval of heat collect, the vaporization effected in each of said vaporization steps being only partial and the liquid phase remaining at the end of said vaporization steps being recycled to the condensation step according to the arrangement described in example 2 in the case of one single vaporization step.

On the other hand, various types of materials known to the specialists can be used in the process conforming to the invention.

The evaporator and the condenser may be, for example, tube-and-calendar exchangers, double-tube exchangers or plate exchangers. When the exchange is effected with a gas, for example, if air is used as cooling fluid in the condenser, it is generally advantageous to provide the exchange surfaces with ribs placed on the gas side to improve the thermal exchange with this gas.

The expansion of the vapor phase generated in the evaporator, which results in the production of mechanical power, can be effected in all machines known for that use: this machine may be, for example, a one-wheel turbine or a multi-wheel turbine, of the radial or axial type, a screw machine of the same type as the screw compressors but working by expansion, a blade motor or an alternative piston engine.

The power delivered may vary widely from, for example, a few kw to several Megawatts.

In the following claims, it is pointed out that the mixture of fluids does not form an azeotrope in the vaporization conditions. This means that at least two constituents of the mixture do not form a common azeotrope; however each of the constituents may individually be an azeotrope.

What is claimed is:

1. A process for producing mechanical power, comprising (a) progressively vaporizing at least one portion of a fluids mixture (M) comprising at least two constituents which do not form an azeotrope in the vaporization conditions, by recovering vaporization heat at least partly from an external fluid I whose temperature varies in a temperature interval A' during the exchange, the temperature of the mixture varying in a temperature interval A defined as the interval between the bubble point ($T_{LB}$) of the liquid and the dew point of the vapor ($T_{VR}$) during said vaporizing step, (b) expanding the resultant vapor phase to produce mechanical power, (c) progressively condensing, in a temperature interval B defined as the interval between the dew point of the vapor and the bubble point of the liquid during the condensing step, the resultant vapor while delivering heat to at least one external fluid II whose temperature varies in a temperature interval B', the width of the temperature interval B being at least 7° C. and at most 30° C., and (d) recycling to step (a) the liquid phase from step (c), the heat exchanges effected with the external fluids I and II in the steps (a) and (c) respectively being operated counter-currently, the mixture of fluids vaporizing in step (a) according to an increasing temperature evolution parallel to the decreasing temperature evolution of the external fluid I and condensing in step (c) according to a decreasing temperature evolution parallel to the increasing temperature evolution of the external fluid II.

2. A process according to claim 1, wherein the fluids mixture is separated into two fractions at a point of the circuit and the resultant fractions are re-mixed at another point of the circuit, the first of these separated fractions being circulated through all the steps (a), (b) and (c) and the second of these fractions being not subjected to at least one of the steps through which circulates the first one of these fractions.

3. A process according to claim 1 wherein the difference between the temperature of the mixture working in interval A and the temperature of the fluid I working in interval A' is at each time lower than 5° C.

4. A process according to claim 1 wherein the mixture (M) is vaporized in at least two steps effected at distinct pressure levels, a first fraction of the mixtue being vaporized at the highest pressure level by receiving heat in a first temperature interval, the resultant vapor phase being supplied to the inlet of the working machine where the expanding takes place, said working machine comprising a number of stages at least equal to the number of vaporization stages, the remaining fraction being vaporized in at least one step effected at a pressure level lower than the pressure level of the first step by recovering heat in a temperature interval which is at least in part below the first temperature interval, the resultant vapor fraction(s) being fed to the successive stages of the power machine where the expansion takes place, at points corresponding to the pressure levels of the vapor, the vapor mixture obtained after expansion being condensed and the condensed liquid phase being recycled to the vaporization steps.

5. A process according to claim 1 wherein the mixture (M) is partially vaporized in the evaporator by receiving heat from an external fluid, the resultant vapor phase and liquid phase being separated, the vapor phase being expanded with mechanical power production, the liquid phase being supplied to an exchanger where it exchanges heat with the condensed mixture (M) which is fed to the evaporator, the liquid phase being thereafter expanded and admixed with the expanded vapor phase, the resultant liquid-vapor mixture being condensed with heat release to an external fluid, the resultant condensed mixture (M) being recycled to the evaporator.

6. A process according to claim 1 wherein the mixture is a hydrocarbons mixture whose number of carbon atoms is from 3 to 8.

7. A process according to claim 1 wherein the mixture is a mixture of halogenated hydrocarbons.

8. A process according to claim 1 wherein the mixture is a mixture of water with at least one constituent miscible with water, selected from alcohols, ketones and amines.

9. A process according to claim 1 wherein the mixture is a mixture of water with ammonia.

10. A process according to claim 1 wherein the temperature interval A is comprised in the temperature range from 50° to 350° C. and the temperature interval B is comprised in the temperature range from 20° to 80° C.

11. A process according to claim 1 wherein the pressure of the mixture in the evaporator is selected between 3 and 30 bars and the pressure of the mixture in the condenser is selected between 1 and 10 bars.

12. A process according to claim 1 wherein the mechanical power produced by expanding the vapor phase mixture is converted to electric power.

* * * * *